US008109786B2

(12) United States Patent
Lee et al.

(10) Patent No.: US 8,109,786 B2
(45) Date of Patent: Feb. 7, 2012

(54) CONNECTOR FOR COAXIAL CABLE

(75) Inventors: Hyoung-Koog Lee, Gwangmyeong-si (KR); Bong-Kwon Cho, Gumi-si (KR); Sang-Hyun Song, Seocho-gu (KR); Young-Il Cho, Songpa-gu (KR); Kwang-Su Nam, Suwon-si (KR); Youn-Jung Kim, Gyeyang-gu (KR)

(73) Assignee: LS Cable & System Ltd., Anyang-si, Gyeonggi-do (KR)

( * ) Notice: Subject to any disclaimer, the term of this patent is extended or adjusted under 35 U.S.C. 154(b) by 178 days.

(21) Appl. No.: 12/686,437

(22) Filed: Jan. 13, 2010

(65) Prior Publication Data

US 2010/0178799 A1 Jul. 15, 2010

(30) Foreign Application Priority Data

Jan. 13, 2009 (KR) ..... 10-2009-0002694

(51) Int. Cl.
*H01R 9/05* (2006.01)

(52) U.S. Cl. ..... 439/578

(58) Field of Classification Search ..... 439/583, 439/584, 578–582

See application file for complete search history.

(56) References Cited

U.S. PATENT DOCUMENTS

| | | | |
|---|---|---|---|
| 4,046,451 | A | 9/1977 | Juds et al. |
| 4,585,289 | A | 4/1986 | Bocher |
| 5,938,474 | A | 8/1999 | Nelson |
| 6,217,384 | B1 | 4/2001 | Strasser et al. |
| 6,386,915 | B1 | 5/2002 | Nelson |
| 2007/0149047 | A1 | 6/2007 | Wild et al. |

FOREIGN PATENT DOCUMENTS

| | | |
|---|---|---|
| FR | 2916089 | 11/2008 |
| KR | 20-0415859 | 5/2006 |
| KR | 10-0800789 | 2/2008 |

OTHER PUBLICATIONS

Great Britain Intellectual Property Office, Combined Search and Examination Report under Sections 17 & 18(3) for GB Application No. GB1000526.2, May 12, 2010.

German Patent and Trademark Office, Office Action for DE Application No. 10 2010 004 396.6-34, Oct. 25, 2010.

*Primary Examiner* — Khiem Nguyen

(74) *Attorney, Agent, or Firm* — Sherr & Vaughn, PLLC

(57) ABSTRACT

A connector for a coaxial cable physically and electrically connects a coaxial cable with various kinds of electric members. The coaxial cable includes a hollow inner conductor and a corrugated outer conductor surrounding the inner conductor. A carrier terminal inserted into the inner conductor of the coaxial cable has a diameter elastically adjusted to an inner diameter of the inner conductor.

7 Claims, 2 Drawing Sheets

CONNECTOR FOR COAXIAL CABLE

CROSS REFERENCE TO PRIOR APPLICATION

The present application claims priority under 35 U.S.C. 119 to Korean Patent Application No. 10-2009-0002694 (filed on Jan. 13, 2009), which is hereby incorporated by reference in its entirety.

BACKGROUND OF THE INVENTION

1. Field of the Invention

The present invention relates to a connector for a coaxial cable, and more particularly, to a connector for a coaxial cable that secures a high-reliability electrical contact although there are changes in an inner diameter of a hollow inner conductor of the coaxial cable.

2. Description of the Related Art

A coaxial cable comprises an inner conductor that is a medium of signal transmission, an insulator surrounding the inner conductor, an outer conductor surrounding the insulator, and a sheath surrounding the outer conductor. The coaxial cable is more strongly resistant to interference of external electromagnetic waves than other cables, and thus, it is currently used in many industrial fields.

The inner conductor of the coaxial cable may have a shape of a solid cylinder or a hollow cylinder. Generally, the solid cylinder-shaped inner conductor is used to a coaxial cable having a relatively smaller diameter, and the hollow cylinder-shaped inner conductor is used to a coaxial cable having a relatively larger diameter. And, the outer conductor of the coaxial cable may have a flat type and a corrugated type. A coaxial cable with the flat type outer conductor allows easy manufacturing and small diameter, and a coaxial cable with the corrugated type outer conductor allows relatively better properties of signal attenuation and cable bending.

For a special purpose of use, the coaxial cable needs to be electrically connected with other coaxial cables or electrical equipments such as a measuring equipment, an operating equipment, a control equipment and so on. For example, the coaxial cable may be connected with another coaxial cable for extending the length of a signal transmission line. The coaxial cable may be connected with a measuring equipment for quality test. The coaxial cable may be electrically connected with an operating equipment and a control equipment for signal transmission therebetween.

A connector is used to connect the coaxial cable with another coaxial cable or an electrical equipment. The connector comprises a pin, a housing, and an insulator. The pin connects an inner conductor of a coaxial cable with an inner conductor of another coaxial cable or an inner conductor of a coaxial cable with a signal receiving/transmitting unit of an electrical equipment. The housing connects an outer conductor of a coaxial cable with an outer conductor of another coaxial cable or an outer conductor of a coaxial cable with a ground of an electric equipment. The insulator insulates the pin from the housing.

In the case that the inner conductor is a hollow inner conductor, the pin of the connector is inserted into a hollow of the inner conductor. The pin inserted into the hollow of the inner conductor is contacted with the inner surface of the inner conductor. In this way, the coaxial cable is electrically coupled with the connector. At this time, if a contact between the pin of the connector and the inner conductor of the coaxial cable is incomplete, a signal flowing toward the inner conductor may be distorted or attenuated while passing through the connector. For this reason, a complete contact should be guaranteed between the pin of the connector and the inner conductor of the coaxial cable.

However, a pin of a conventional connector has a fixed diameter. Thus, when the pin is inserted into an inner conductor having a larger inner diameter than a diameter of the pin, a contact between the pin and the inner conductor is not guaranteed to be complete.

SUMMARY OF THE INVENTION

It is an object of the present invention to provide a connector for a coaxial cable applicable to coaxial cables of different inner diameters without any design change.

In order to achieve the object, the present invention provides a connector for a coaxial cable that allows a physical and electrical connection between a coaxial cable and various kinds of electric members. The coaxial cable includes a hollow inner conductor and a corrugated outer conductor. The connector for a coaxial cable according to the present invention comprises a carrier terminal inserted into and contacted with the hollow inner conductor to transmit an electrical signal of the coaxial cable to the electric member; a conductive housing for receiving the conductive carrier terminal therein and for electrically interfacing the coaxial cable with the electric member and coupling the coaxial cable to a ground; and an insulator interposed between the carrier terminal and the housing and for insulating the carrier terminal from the housing, wherein the conductive carrier terminal has a conductive elastic assembly with an adjustable diameter such that a size of a part of the conductive carrier terminal inserted into the inner conductor corresponds to an inner diameter of the inner conductor, thereby forming a close electrical contact with the conductive carrier terminal irrespective of the inner diameter of the inner conductor.

The conductive carrier terminal includes a conductive pin having a shape of an elongated bar; and a conductive elastic carrier member attached to a part of the conductive pin inserted into the inner conductor and having an adjustable size to the inner diameter of the inner conductor. And, the elastic carrier member has a plurality of curved elastic bars arranged in a circumferential direction and combined to form a circle, and each curved elastic bar is bent convexly to form a conductive elastic carrier member of a circular shape having a larger size than the inner diameter of the inner conductor. The curved elastic bar includes a fixed end fixed to the pin; and a contact body extending from the fixed end and forming an electrical elastic contact with an inner surface of the inner conductor, wherein the contact body is bent convexly with regard to a vertex, so that when the contact body is inserted into the inner conductor, the contact body is pressed down and elastically deformed by an external force, and when the external force disappear, the contact body is elastically restored to its original state.

The connector for a coaxial cable according to the present invention further comprises a coupling member for electrically coupling the outer conductor with the housing. The coupling member includes a conductive pipe inserted and fixed in the housing; and a conductive wing assembly installed in the conductive pipe for electrically coupling the outer conductor with the housing.

The conductive wing assembly has a plurality of conductive wings arranged in a circumferential direction and combined to form a circle. The conductive wing includes a nipper connected with the outer conductor; and a protrusion coupled with the housing, wherein the nipper is inserted and secured in a corrugation of the corrugated outer conductor of the coaxial cable, and the protrusion is surface-contacted with the housing.

Advantageous Effects

The present invention secures a high-reliability electrical contact with various kinds of coaxial cables having different inner diameters, and thus prevents signal distortion or excessive attenuation.

And, the present invention secures easy insertion/drawing of a carrier terminal of a connector into/from an inner conductor.

DESCRIPTION OF THE PREFERRED EMBODIMENT

Hereinafter, preferred embodiments of a connector for a coaxial cable according to the present invention will be described in detail with reference to the accompanying drawings.

Figure 1:
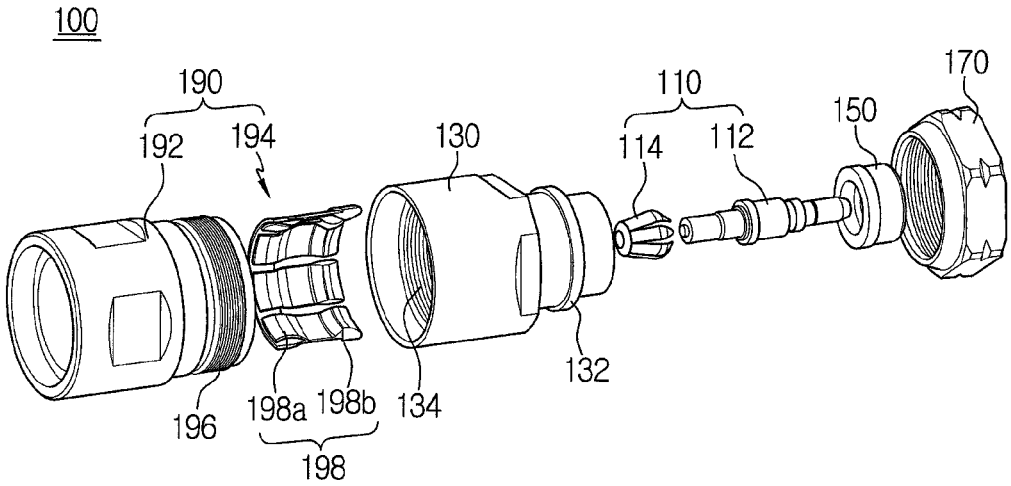
FIG. 1 is an exploded perspective view of an example of a connector for a coaxial cable according to a present invention.
Figure 2:
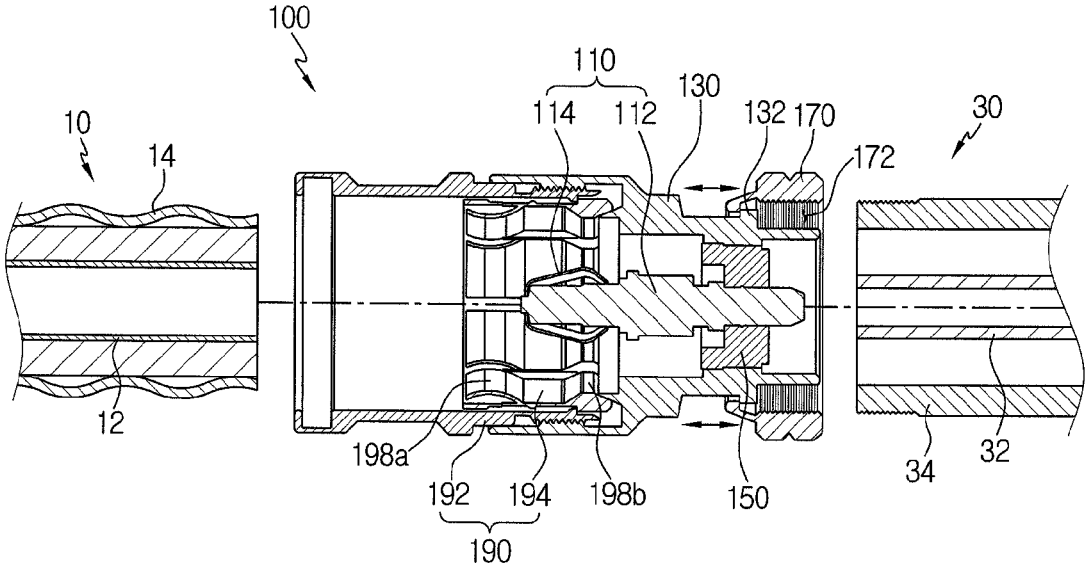
FIG. 2 is a cross-sectional view of the connector of the coaxial cable of FIG. 1.
Figure 3:
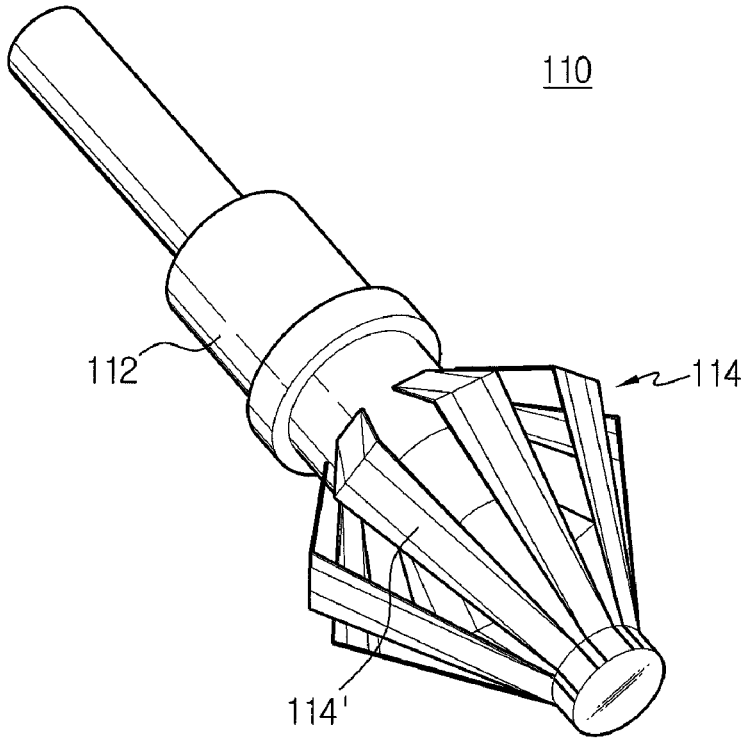
FIG. 3 is a perspective view of a carrier terminal according to the present invention, comprising a pin and an elastic carrier member attached to the pin.
Figure 4:
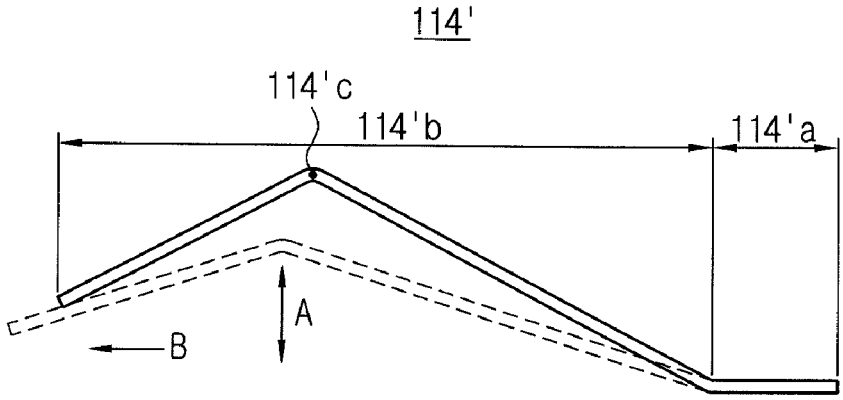
FIG. 4 is an enlarged cross-sectional view of a curved elastic bar according to the present invention.

FIG. 1 is an exploded perspective view of an example of a connector for a coaxial cable according to a present invention. FIG. 2 is a cross-sectional view of the connector of the coaxial cable of FIG. 1. FIG. 3 is a perspective view of a carrier terminal according to the present invention, comprising a pin and an elastic carrier member attached to the pin. FIG. 4 is an enlarged cross-sectional view of a curved elastic bar according to the present invention.

As shown in FIGS. 1 and 2, a connector 100 for a coaxial cable according to a present invention comprises a carrier terminal 110 electrically connected with an inner conductor 12 of a coaxial cable 10, a housing 130 serving as a ground of the connector 100, an insulator 150 for insulating the carrier terminal 110 from the housing 130, and a coupling member 190 for electrically interfacing an outer conductor 14 of the coaxial cable 10 with the housing 130.

The carrier terminal 110 is a medium for electrically coupling the hollow inner conductor 12 of the coaxial cable 10 with a connection part 32 of a specific electric member 30. Here, the specific electric member 30 may include a connector of another coaxial cable, a measuring equipment, an operating equipment, a control equipment and so on.

When the connector 100 and the coaxial cable 10 are physically connected with each other, one end of the carrier terminal 110 of the connector 100 is fitted into a hollow of the inner conductor 12 of the coaxial cable 10. And, when the connector 100 and the electric member 30 are physically connected with each other, the other end of the carrier terminal 110 of the connector 100 is electrically connected with the connection part 32 of the electric member 30.

Referring to FIG. 3, the carrier terminal 110 has a pin 112 and an elastic carrier member 114. Each of the pin 112 and the elastic carrier member 114 is made of a conductive material. The elastic carrier member 114 is a conductive elastic assembly having a plurality of curved elastic bars 114' arranged in a circumferential direction and combined to a circle. Referring to FIG. 4, each of the curved elastic bars 114' has a fixed end 114'*a* fixed and joined to the pin 112, and a contact body 114'*b* inserted into the inner conductor 12 of the coaxial cable 10 and contacted with the inner surface of the inner conductor 12. The contact body 114'*b* has the degree of freedom in the radial (arrow A) and longitudinal (arrow B) directions with regard to the fixed end 114'*a*. The contact body 114'*b* has a shape bent at a predetermined angle (for example, an obtuse angle of 120 degrees or more) relative to a vertex 114'*c* such that its maximum height before elastic deformation is at least larger than the height of the inner conductor 12 of the coaxial cable 10.

And, the curved elastic bars 114' have elastic retention. Thus, when an external force is applied to the curved elastic bars 114', the curved elastic bars 114' are deformed as indicated by a dotted line in FIG. 4. When the external force disappears, the curved elastic bars 114' are restored to their original state as indicated by a solid line in FIG. 4. That is, when the carrier terminal 110 is inserted into the inner conductor 12 of the coaxial cable 10 by a physical connection of the coaxial cable 10 and the connector 100, the curved elastic bars 114' of the carrier terminal 110 are elastically deformed as indicated by the dotted line in FIG. 4. When the connection of the coaxial cable 10 and the connector 100 is released, the curved elastic bars 114' are restored to their original shape as indicated by the solid line in FIG. 4.

As mentioned above, if the carrier terminal 110 is press-fit engaged with the inner conductor 12 of the coaxial cable 10, the curved elastic bars 114' of the carrier terminal 110 are elastically deformed as indicated by the dotted line in FIG. 4, so that an electrical contact is formed between the curved elastic bars 114' and the inner surface of the inner conductor 12. At this time, because the curved elastic bars 114' are bent at a predetermined angle relative to the vertex 114'*c*, it is easy to insert/draw the carrier terminal 110 into/from the inner conductor 12 of the coaxial cable 10. Accordingly, the connector 100 of the present invention can flexibly establish an electrical connection with coaxial cables having different inner diameters of inner conductors, thereby providing a reliable connecting environment.

Meanwhile, the insulator 150 is located between the carrier terminal 110 and the housing 130, and electrically insulates the carrier terminal 110 from the housing 130.

And, the housing 130 is made of a conductive material to electrically interface the outer conductor 14 of the coaxial cable 10 with a ground 34 of the electric member 30. The housing 130 receives the carrier terminal 110 and the insulator 150 therein.

First, the housing 130 and the ground 34 of the insulator 30 are electrically connected with each other by a bolt-nut connection. The bolt-nut connection is established by inserting the bolt 34 into a space 172 between the housing 130 and the nut 170 and rotating the nut 170. And, the housing 130 has a flange 132 for preventing the nut 170 from moving away from the housing 130. Meanwhile, the locations of the nut 170 and the bolt 34 may be reversed. That is, modification may be made such that a bolt is formed at one end of the housing 130 and a nut is formed at the ground 34 of the electric member 30.

And, the housing 130 and the outer conductor 14 of the coaxial cable 10 are electrically connected with each other by the coupling member 190. The coupling member 190 has a conductive pipe 192 and a conductive wing assembly 194 connected with the inner surface of the conductive pipe 192. The conductive pipe 192 has a male screw 196 formed along the outer periphery thereof. The male screw 196 is engaged with a female screw 134 formed along the inner periphery of the housing 130.

The conductive wing assembly 194 has a plurality of conductive wings 198 arranged in the circumferential direction and combined to form a circle. Each of the conductive wings 198 has a nipper 198*a* coupled with the outer conductor 14 of the coaxial cable 10, and a protrusion 198*b* coupled with the housing 130 of the connector 100. The nipper 198*a* is inserted and secured into a corrugation of the corrugated outer conductor 14 of the coaxial cable 10, and the protrusion 198*b* is surface-contacted with the housing 130. In this way, the outer conductor 14 is physically and electrically connected with the housing 130 through the coupling member 190.

Hereinafter, description is made on a process for physically and electrically connecting the coaxial cable 10 with various kinds of electric members 30 using the connector 100 of the above-mentioned configuration according to the present invention.

The sheath of the coaxial cable 10 to be connected is striped off. As shown in FIG. 2, the outer conductor 14 is inserted into the coupling member 190 of the connector 100 with the outer conductor 14 exposed outward. Then, the outer conductor 14 is physically and electrically connected with the conductive pipe 192 while the nipper 198*a* of the conductive wing assembly 194 of the coupling member 190 is interposed therebetween. The conductive wing assembly 194 is physically and electrically connected with the conductive pipe 192 and the housing 130 through the protrusion 198*b*. Meanwhile, the connector 100 is physically and electrically connected with the electric member 30 by connection of the nut 170 of the housing 130 of the connector 100 and the bolt 34 of the electric member 30.

And, as the coaxial cable 10 is inserted in the housing 130 through the coupling member 190, the carrier terminal 110 is inserted into a hollow of the inner conductor 12 of the coaxial cable 10 to form an electrical contact, so that an electrical connection is established between the coaxial cable 10 and the electric member 30. At this time, although the inner diameter of the inner conductor 12 is larger than the diameter of the pin 112 of the carrier terminal 110, because the pin 112 has the elastic carrier member 114 attached thereto, a high reliability-electrical contact can be formed between the inner conductor 12 and the pin 112 through an elastic mechanism shown in FIG. 4.

What is claimed is:

1. A connector for a coaxial cable, establishing a physical and electrical connection between a coaxial cable and various kinds of electric members, the coaxial cable including a hollow inner conductor and a corrugated outer conductor surrounding the hollow inner conductor, the connector comprising:

a conductive carrier terminal inserted into and contacted with the hollow inner conductor to transmit an electrical signal of the coaxial cable to an electric member;

a conductive housing for receiving the conductive carrier terminal therein and for electrically interfacing a coaxial cable with the electric member and coupling the coaxial cable to a ground; and a coupling member for electrically coupling the outer conductor with the housing;

an insulator interposed between the carrier terminal and the housing for insulating the carrier terminal from the housing, wherein the conductive carrier terminal has a conductive elastic assembly with an adjustable diameter such that a size of a part of the conductive carrier terminal inserted into the inner conductor corresponds to an inner diameter of the inner conductor, thereby forming a close electrical contact with the conductive carrier terminal irrespective of the inner diameter of the inner conductor.

2. The connector for a coaxial cable according to claim 1, wherein the conductive carrier terminal includes:

a conductive pin having a shape of an elongated bar; and a conductive elastic carrier member attached to a part of the conductive pin inserted into the inner conductor and having a size adjustable to the inner diameter of the inner conductor.

3. The connector for a coaxial cable according to claim 2, wherein the elastic carrier member has a plurality of curved elastic bars arranged in a circumferential direction and combined to form a single circle, each curved elastic bar being convexly bent to form a conductive elastic assembly of a circular shape having a larger size than the inner diameter of the inner conductor.

4. The connector for a coaxial cable according to claim 3, wherein the curved elastic bar includes:

a fixed end fixed to the pin; and a contact body extending from the fixed end and forming an electrical elastic contact with an inner surface of the inner conductor, wherein the contact body is bent convexly with regard to a vertex, so that when the contact body is inserted into the inner conductor, the contact body is pressed down and elastically deformed by an external force, and when the external force disappears, the contact body is elastically restored to its original state.

5. The connector for a coaxial cable according to claim 4, wherein the coupling member includes:

a conductive pipe fixed in the housing; and a conductive wing assembly installed in the conductive pipe for electrically coupling the outer conductor with the housing.

6. The connector for a coaxial cable according to claim 5, wherein the conductive wing assembly has a plurality of conductive wings arranged in a circumferential direction and combined to form a single circle.

7. The connector for a coaxial cable according to claim 6, wherein the conductive wing includes:

a nipper coupled with the outer conductor; and a protrusion coupled with the housing, wherein the nipper is inserted and secured in a corrugation of the corrugated outer conductor of the coaxial cable, and the protrusion is surface-contacted with the housing.

* * * * *